US005566470A

United States Patent [19]

Morrison

[11] Patent Number: 5,566,470

[45] Date of Patent: Oct. 22, 1996

[54] METERING GRAIN UNLOADER FOR TOWER DRYER

[75] Inventor: David W. Morrison, Macoupin County, Ill.

[73] Assignee: Grain Systems, Inc., Assumption, Ill.

[21] Appl. No.: 372,234

[22] Filed: Jan. 13, 1995

[51] Int. Cl.[6] ..... F26B 17/12

[52] U.S. Cl. ..... 34/167; 34/174

[58] Field of Search ..... 34/166, 167, 174, 34/586

[56] References Cited

U.S. PATENT DOCUMENTS

| | | | |
|---|---|---|---|
| 746,410 | 12/1903 | Turner | 222/328 |
| 3,333,348 | 9/1967 | Ausherman et al. | 34/174 |
| 4,004,351 | 1/1977 | Sanneman et al. | 34/174 |

*Primary Examiner*—F. Daniel Lopez

*Attorney, Agent, or Firm*—Polster, Lieder, Woodruff & Lucchesi, L.C.

[57] ABSTRACT

A metering unloader (29) of the present invention is for use in a tower grain dryer (T). The tower dryer has a grain drying path (11) and the latter has a grain outlet (27) at the lower end thereof, and the tower has at least one discharge outlet (15) in the lower portion thereof. The metering unloader is rotatably mounted within the lower portion (23) of the tower for rotation about a vertical axis (39) and the unloader is powered by a motor (41) for rotatably driving the metering unloader about the vertical axis. The metering unloader is in communication with the grain outlet of the grain drying path and it substantially uniformly removes dried grain from all regions of the lower portion of the dryer upon each revolution of the metering unloader and delivers the dried grain to the discharge outlet for the tower dryer. A method for metering the unloading of grain from the dryer is also disclosed.

10 Claims, 3 Drawing Sheets

METERING GRAIN UNLOADER FOR TOWER DRYER

BACKGROUND OF THE INVENTION

This invention relates to an unloader for a tower grain dryer or the like, and more particularly to such an unloader which meters or positively unloads the dried grain from such a dryer in such manner that dried grain is substantially uniformly removed from all regions of the dryer outlet section.

Tower grain dryers are well known. Generally, they comprise a vertical tower of cylindrical or other shape. The tower has a plenum located within the tower and spaced from the inner surfaces of the outer walls of the tower. Typically, the walls of the tower and of the plenum are of porous construction such that air from within the plenum may be forced through the walls. Grain to be dried is conveyed to the upper reaches of the tower and fills the space between the outer tower wall and the plenum so as to form a drying path for the grain to be dried. As dried grain is continuously discharged from the lower end of the grain drying path, additional grain to be dried is loaded into the upper end of the drying path.

The plenum is supplied with heated air by means of one or more burner/blower assemblies. The heated air is forced from within the plenum through the porous or perforated walls of the plenum, through the grain in the drying path, and is forced through the porous outer wall of the tower carrying away moisture from the grain.

Reference may be made to the following U.S. Patents which describe tower or other similar types of grain dryers of the type discussed above: U.S. Pat. Nos. 3,710,449, 3,766,664, 3,864,845, 3,896,562, 3,955,288, 4,398,356, 4,423,557, 4,914,834, 5,129,164, and 5,136,791.

In certain of these prior art tower grain dryers, the lower portion of the drying path converges inwardly of the tower in a generally conical shape and is divided into a number of separate converging channels. The lower ends of the channels discharge the dried grain into the bottom of the tower to be unloaded. Unloading can be accomplished in a variety of ways. Of course, grain being a fluent material may flow by gravity out through gravity outlets. Alternatively, the grain may be swept from the base of the tower by a sweep auger or the like and conveyed by the sweep auger to a discharge outlet, as described in the above-noted U.S. Pat. No. 3,896,562. Still further, discharge augers may be located directly below the grain drying paths, as shown in U.S. Pat. No. 3,864,845, to unload the dried grain.

However, it has been found that with tower dryers in which the grain drying path converges inwardly at the bottom of the tower and in which the grain drying path is divided into a number of converging channels, dried grain is oftentimes not uniformly removed from all of the channels. It has been found that grain will be removed at faster rates from some of the channels than from others. Because the speed at which the grain moves through the drying path (and hence the amount of time the grain is exposed to the drying air) varies in direct relation to the rate at which the dried grain is removed from the outlets of the channels, prior grain unloaders which did not uniformly remove dried grain from all of the grain channels caused some of the grain to move too fast through the dryer such that this faster moving grain might not be sufficiently dried, while other grain in the drying path might move too slowly such that this slower moving grain might become over dried. Of course, under dried grain is not desirable because it could lead to spoilage of the grain, and over dried grain is not desirable because it might become damaged from excessive exposure to the heated air which would waste energy and may damage the grain.

SUMMARY OF THE INVENTION

Among the several object of the present invention may be noted the provision of a metering unloader installed in the lower reaches of a tower grain dryer for substantially uniformly unloading dried grain from all regions of the outlet portion of the dryer;

The provision of such an unloader in which the drying path of the tower dryer terminates in a number of side-by-side converging channels and in which the dried grain discharged from these channels is substantially uniformly unloaded from all of the channels;

The provision of an unloader which insures that the rate in which the speed of the grain moving through the drying flow path is substantially uniform;

The provision of such i an unloader which positively meters the grain from each region of the grain drying path so as to insure that all of the grain moving through all regions of the grain drying path moves at substantially the same speed and thus is uniformly dried;

The provision of such an unloader in which the rate at which grain may be unloader from the dryer can be regulated by speeding up or slowing down the operation of the unloader;

The provision of such an unloader which is free of jams, is of simple and rugged construction, and which is of economical construction.

Other objects and features of this invention will be in part apparent and in part pointed out hereinafter.

Briefly stated, a metering unloader of the present invention is intended for use in a tower grain dryer. The later comprises a vertical tower having a plenum therein. The plenum has a plenum wall. The tower has an outer wall surrounding the plenum wall with the tower outer wall being spaced outwardly from the plenum for forming a grain drying path between the tower outer Wall and the plenum wall. The grain to be dried is conveyed through the grain drying path generally from the top to the bottom of the dryer. The outer wall of the tower and the plenum wall are porous to permit air to flow therethrough The tower dryer has means for moving air into the plenum, through the plenum wall, through the grain in the grain drying path thereby to dry the grain, and through the tower wall to exhaust the air to the atmosphere on the exterior of the outer tower wall. The grain drying path has a grain outlet at the lower end thereof. The tower has at least one discharge outlet in the lower portion thereof. The metering unloader is rotatably mounted within the lower portion of the Tower for rotation about a vertical axis. Means is provided for rotatably driving the metering unloader about the vertical axis. The metering unloader is in communication with the grain outlet of the grain drying path for substantially uniformly removing dried grain from all regions of the lower portion of the tower upon each revolution of the metering unloader and for the delivery of such dried grain to the at least one discharge outlet.

The method of the present invention relates to substantially uniformly unloading dried grain from a tower grain dryer. The tower dryer has a plenum therewithin with the walls of the plenum being porous, an outer tower wall surrounding the plenum and defining a grain drying path therebetween. The outer tower wall is porous. Means is provided for forcing heated air into the plenum, through the plenum walls, through the grain in the drying path, and through the outer tower wall. The drying path has an outlet end for the discharge of the dried grain into the lower portion of the tower. The lower portion of the tower has a discharge outlet through which the dried grain may be unloaded from the tower dryer. Specifically, the method of this invention comprises the steps of providing a metering unloader in the lower portion of the tower. The unloader has a grain inlet in communication with the dried grain discharged from the outlet end of the drying path, a discharge end in register with the discharge opening, and a path between the grain inlet and the discharge end. The unloader is rotated about a vertical axis. The dried grain is substantially uniformly scooped from all regions of the outlet end of the drying path as the unloader rotates and is conveyed through the path within the unloader to the discharge outlet.

BRIEF DESCRIPTION OF THE DRAWINGS

Corresponding reference characters represent corresponding parts throughout the various views of the drawings.

DESCRIPTION OF PREFERRED EMBODIMENTS

Figure 1:
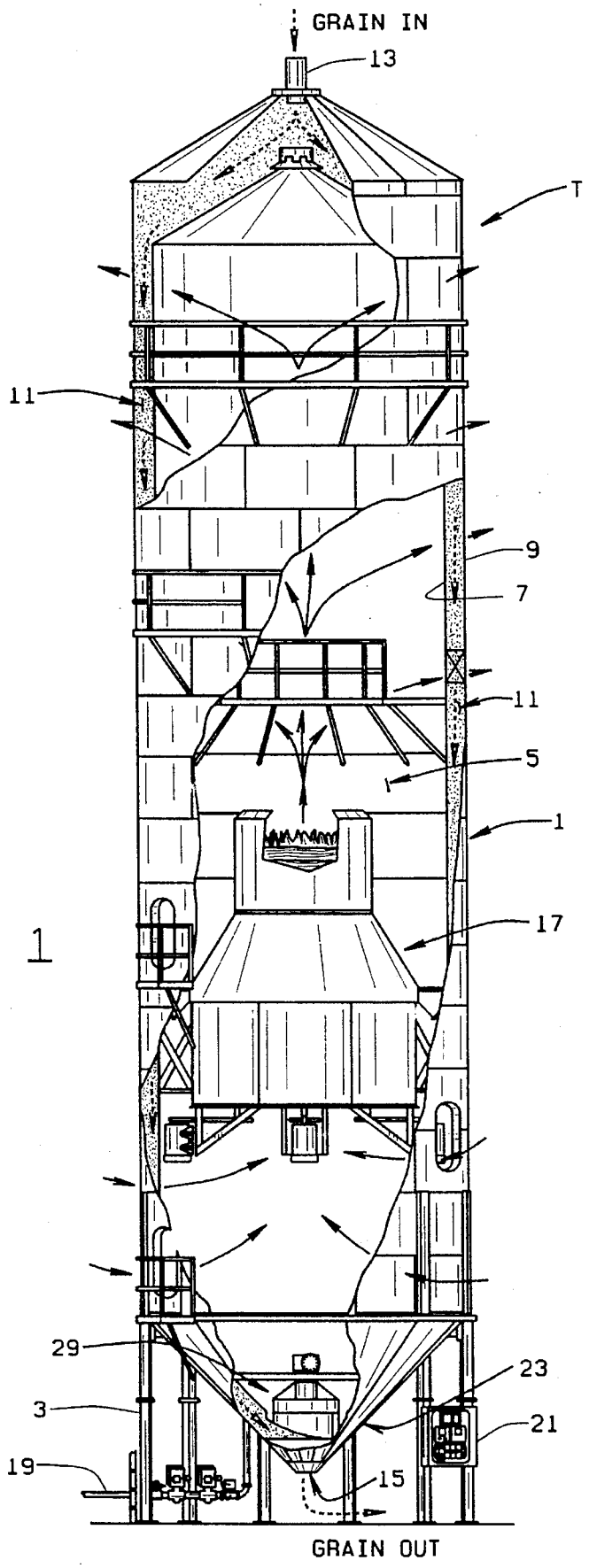
FIG. 1 is an elevational view (with portions broken away) of a tower grain dryer having a metering unloader of the present invention therein.

Referring now to the drawings, and more particularly to FIG. 1, a tower dryer T is shown in partial cross section More specifically, tower dryer T comprises a vertical grain drying tower 1 which may, for example, be fifty feet or more in height. The tower has a base 3 of suitable structural steel members mounted in a suitable foundation (not shown). A plenum 5 is disposed within the grain dryer. The plenum is defined by a generally cylindrical porous plenum wall 7. Tower 1 has an outer cylindrical tower wall 9 of porous construction surrounding plenum wall 7 and spaced outwardly therefrom so as to define a vertical, annular grain drying path 11. Grain may be supplied to grain drying path 11 by means of a grain inlet 13 at the top of tower 1 and dried grain may be discharged from the tower dryer by means of a grain discharge outlet 15 at the lower end of the dryer.

As generally indicated at 17, a heater/blower assembly is provided within the grain dryer for drawing ambient air through the grain path 11 in the lower reaches of the tower and, if demanded, for heating the air, and for discharging the heated air under pressure into plenum 5. In this manner, the air discharged from heater/blower 17 is distributed substantially uniformly within the plenum and is forced to flow through the porous plenum wall 7, through the grain in grain drying path 11, so as to be exhausted through the porous outer walls tower 9 to the atmosphere thereby carrying moisture from the grain to the atmosphere. Whole heater/blower 17 is shown in FIG. 1 to be located within tower 1, it will be understood that within the broader aspects of this invention that the heater/blower may be located outside the tower in close proximity thereto and air from the heater/blower may be ducted into plenum 5.

Typically, fuel for heater/blower assembly 17 is supplied by gas fuel supply lines 19 and operation of the heater/blower assembly and overall operation of tower dryer T is controlled by a computer control housed in a control panel 21. Computer control is preferably of the type disclosed in the co-assigned U.S. patent application Ser. No. 08/193,710 filed Feb. 9, 1994 which is incorporated by reference herein, but reprogrammed to operate with tower dryer T rather than with the continuos flow of grain dryers disclosed in the above noted patent application.

Figure 2:
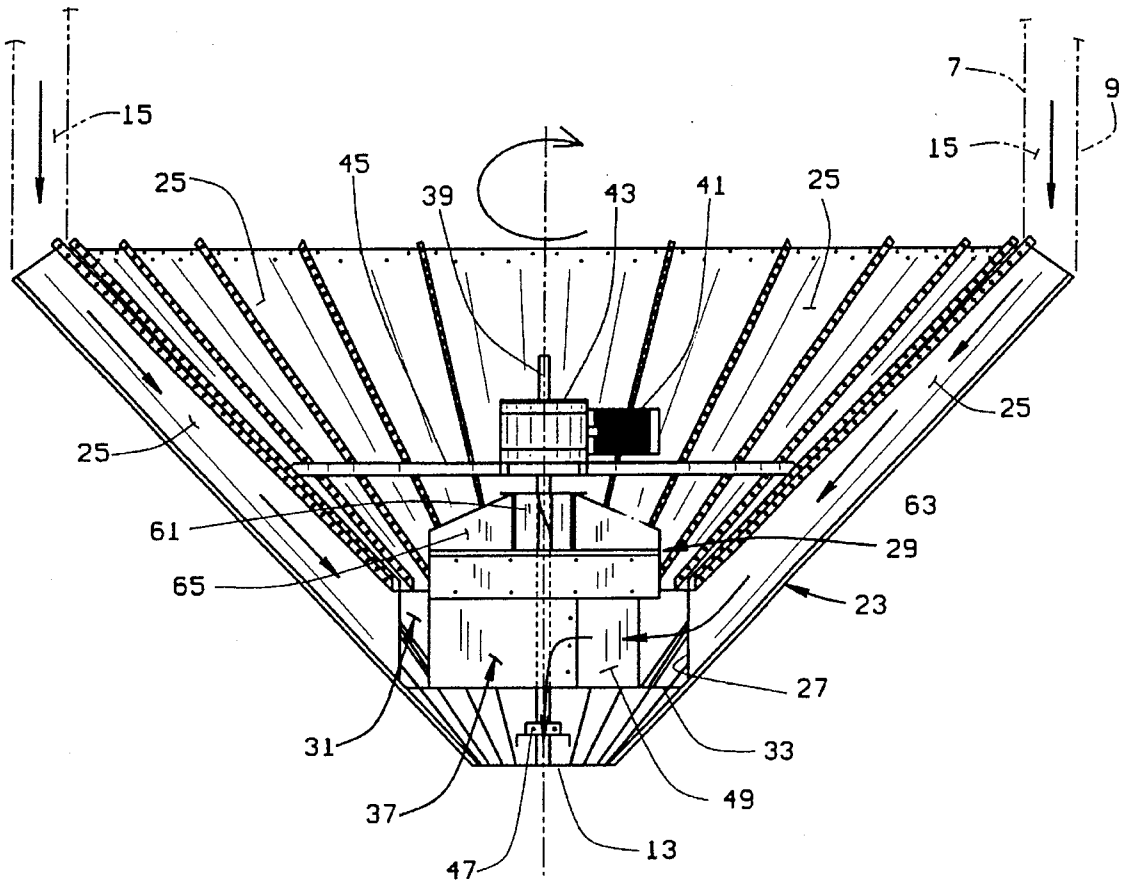
FIG. 2 is an enlarged cross sectional view of the lower portion of the tower dryer shown in FIG. 1 illustrating converging grain channel which direct the dried grain downwardly toward a metering unloader of the present invention.

As shown in FIG. 1, tower 1 has a converging conical hopper bottom 23. As shown in FIG. 2, hopper bottom 23 receives grain from grain drying path 11 and the portion of drying path in hopper bottom 23 is divided into a plurality of converging grain flow channels 25 leading downwardly at the slope of the hopper bottom from the lower cylindrical reaches of the drying path in tower 1. Each of the converging grain channels 25 has a respective grain outlet opening 27 at its lower end for the discharge of dried grain from the drying path 11.

Figure 3:
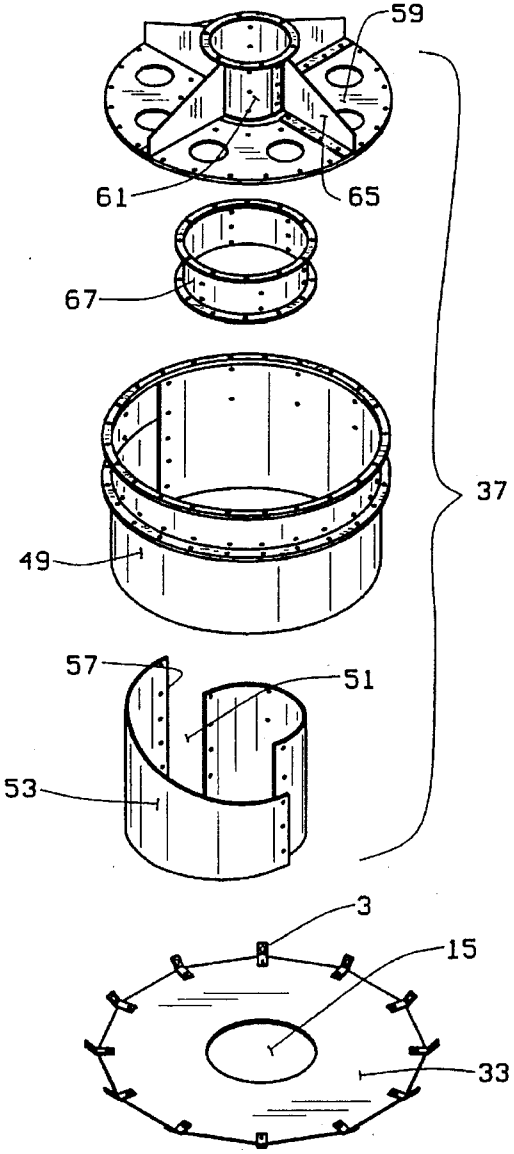
FIG. 3 is an exploded perspective view of the major components of the metering unloader body.

As generally indicated at 29, a metering grain unloader of the present invention is provided in the lower reaches of hopper bottom 23 for receiving grain discharged from grain outlet openings 27 for positive, metered unloading of the dried grain from each of the outlet openings 27, and for conveying this dried grain to grain discharge outlet 15 such that dried grain is substantially uniformly unloaded from all of the grain channels 25. Metering grain unloader 29 is somewhat smaller in diameter than the diameter of the lower end of hopper bottom 23 at the height of grain outlet openings 27 so as to form an annular grain channel 31 interposed between the grain outlet openings 27 and the body of metering grain unloader 29. The lower end of hopper bottom 23 is closed off by a generally horizontal bottom wall 33. As shown in FIG. 3., bottom wall 33 has grain discharge opening 15 at the center thereof. The bottom wall is provided with a plurality of attachment tabs 35 which allow the bottom wall to be bolted to the inner surface of the conical hopper bottom 23.

In accordance with this invention, metering grain unloader 29 is mounted within hopper bottom 23 for rotation about a vertical axis for positively gathering grain from within annular grain channel 31 and for positively discharging the dried grain through grain discharge opening 15 in bottom wall 33. More specifically, metering grain unloader 29 comprises an unloader body 37 secured to a vertical shaft 39. Shaft 39 is rotated by a variable speed drive motor 41 having a speed gear reducer 43. The motor and speed reducer are mounted on a motor frame 45 secured to the inner walls of hopper bottom 23 above unloader body 37. The lower end of vertical shaft 39 is journalled in a lower bearing 47 located below opening 15 in bottom wall 33.

Figure 5:
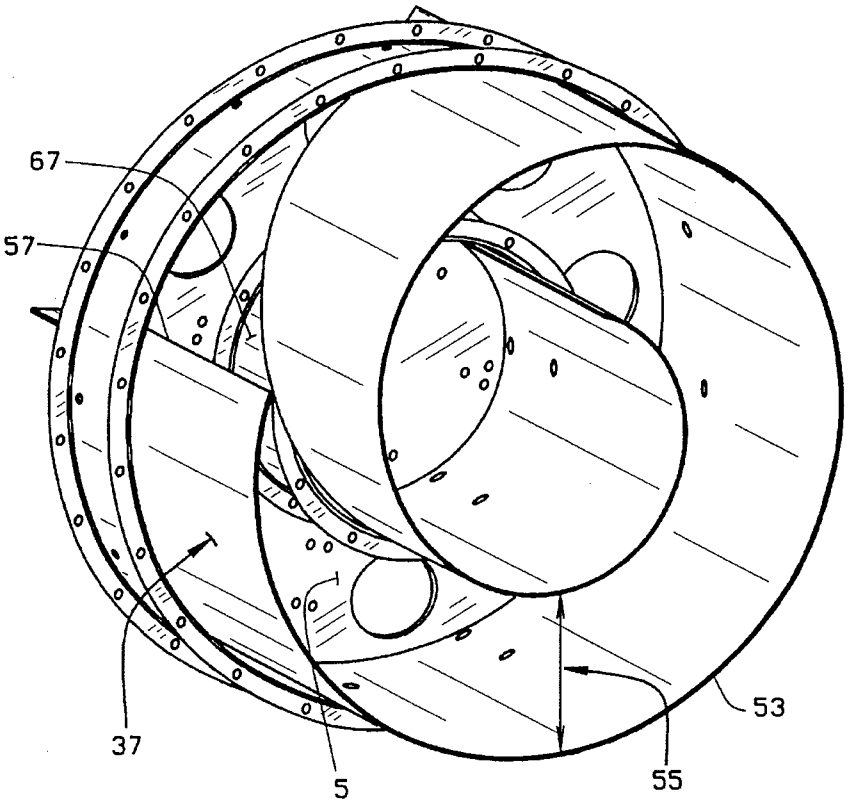
FIG. 5 is an end perspective view of the unloader body with the outer cylindrical wall removed so as to illustrate the spiral internal wall of the unloader which forms a spiral or involute shaped grain unloading path extending between a grain inlet opening within the unloader and a grain discharge outlet for the tower dryer.
Figure 4:
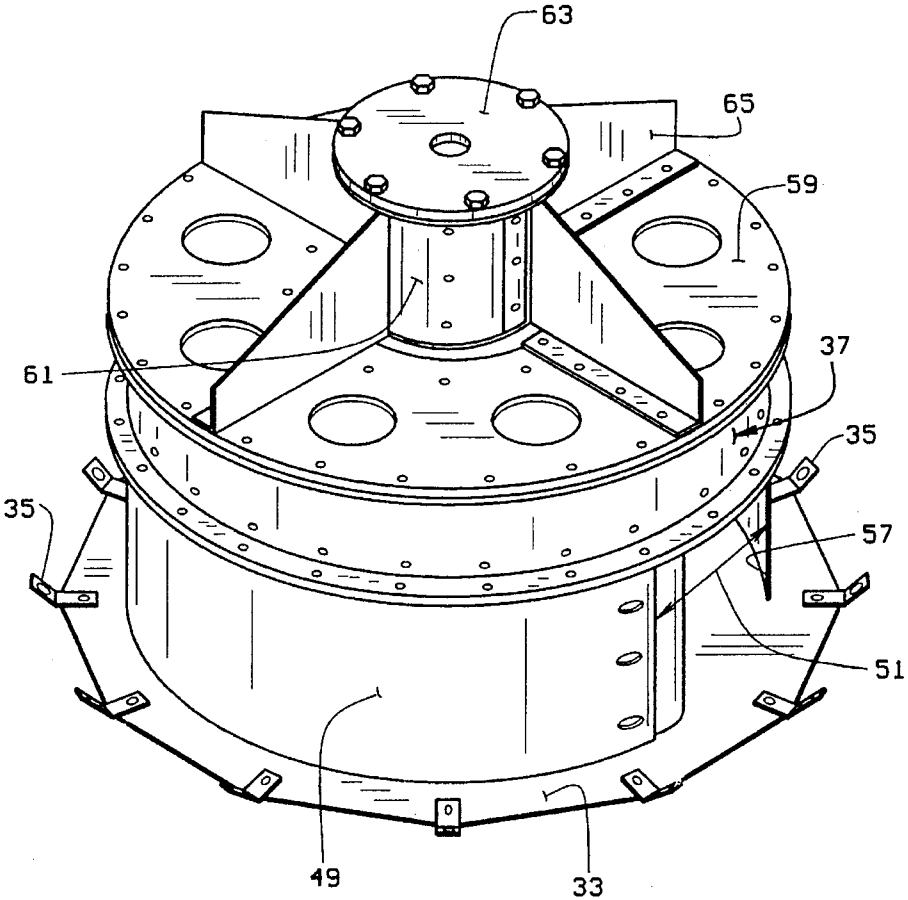
FIG. 4 is a perspective view of the unloader body on a somewhat larger scale than FIG. 3.

More specifically, unloader body 37 has an outer cylindrical body wall 49 defining the inner surface of annular grain channel 31. This vertical cylindrical wall 49 extends upwardly from bottom wall 33. Cylindrical wall 49 has a grain inlet opening 51 therein. Unloader body 37 further has a spiral wall 53 mounted within cylindrical body wall 49 extending up from bottom wall 33 and defining a spiral shaped grain unloading path 55 (see FIG. 5) within the unloader body. Spiral wall 53 has a leading edge 57 which also constitutes the trailing edge of grain inlet opening 51. In this manner, as metering grain unloader 29 is rotated in clockwise direction (when viewed from above) with vertical shaft 39, grain inlet opening 51 rotates around the inner surface of annular grain channel 31 thereby to uniformly pick up grain discharged from each grain outlet opening 27 from each of the tapered grain channels 25. Rotary motion of the metering grain unloader causes the grain to flow within grain unloading path 55 from grain inlet opening 51 to a grain discharge opening 15 in bottom wall 33 and thence to be discharged from tower dryer T in to a suitable grain unloading auger or the like (not shown).

Metering unloader body 37 further comprises a cover plate 59 secured to the upper surface of cylindrical wall 49. A hub 61 is carried on the upper surface of cover plate 59. A hub cover plate 63 is secured to the upper face of hub 61. The hub cover plate in turn in secured to vertical shaft 39. In this manner, metering unloader body 37 is secured to vertical shaft 39 so as to be rotatable therewith. As noted above, the bottom end of shaft 39 is received in bearing 47 such that the weight of the metering body is supported by the drive shaft which in turn is supported by frame 45 and bearing 47. Unloader body 37 is adjusted such that the lower edge of cylinder wall 49 is just clear of floor 33 such that as the metering unloader body is rotated with drive shaft 39, the weight of the metering unloader body does not bear on floor 33. Hub webs 65 stiffen cover plate 59 and help support the cover plate relative to hub 61. An inner cylinder 67 is secured to the bottom of cover plate 59 and the lower rim of the inner cylinder 67 is secured to the upper, inner margins of spiral wall 53 thereby to rigidly support the spiral wall at its center and to securely hold the spiral all in place relative to unloader body 37 and to thus accurately maintain the spiral or involute shape of grain unloading path 55 as the grain unloader 29 rotates with shaft 39.

In operation, grain to be dried is loaded within tower dryer T via grain inlet 11 at the top of the tower. The grain flows down over the conical cap of plenum 5 and is uniformly distributed into the vertical, annular grain drying path 11 and fills the grain drying path from top to bottom. It will be understood that as the grain fills the drying tower it will be initially discharged from outlet openings 27 from grain channels 25 so as to substantially fill annular space 31 and to surround metering unloader body 37. Once the annular space 31 becomes filled with grain to a level somewhat above the tops of grain outlet openings 27, the grain will back up within grain chutes 25. Continued loading of grain into tower 2 will fill the vertical grain drying path 11 with grain.

Once the grain drying path 11 has been filled with grain, as above described, heater/blowers 17 are operated such that heated air is discharged under pressure into plenum 5. The heated air is distributed uniformly within the plenum and is forced through the porous plenum wall 7 into the grain in the grain drying path 11, through the grain to pick up moisture therefrom, and is discharged to the atmosphere via the porous outer tower wall 9 forming the outer surface of the grain drying path.

In order to unload grain from tower dryer T, drive motor 41 is energized so as to rotate vertical shaft 39 and to thus cause unloader body 37 to rotate with the shaft. As noted, annular grain channel 31 surrounding body wall 49 of the unloader body is filled with dried grain discharged from grain outlet openings 27 in grain channels 25 within hopper section 23 of the tower dryer. As the unloader body 37 rotates with vertical shaft 39, the leading edge 57 of grain inlet opening 51 rotates through the grain within annular grain space 31 and positively scoops up grain from the annular grain space and directs the dried grain into grain unloading path 55. Continued turning of unloader body 37 causes the grain within grain unloading path 55 to be conveyed within the grain unloading path from grain inlet 51 to the inner end of the grain unloading path for discharge from the tower dryer via grain discharge outlet 15 located within the bottom wall 33. As noted, a suitable grain discharge auger unloader or the like (not shown) may be provided to convey the dried grain from the tower dryer.

As indicated by the arrows in FIG. 1, ambient air is drawn into tower T through the lower reaches of the outer porous tower wall 9, through the grain which has been heated and dried in the upper reaches of the tower and thence through the porous inner plenum wall 7 for intake into the heater/blower 17. This cooler, ambient air passing through the heated, dried grain tends to cool the grain and to recover heat from the grain so that at least some of the heat is regenerated and is again utilized in the drying process. It will also be appreciated that the heated grain in the lower portion of the grain drying path 11 is substantially free of excess moisture such that the inflow of air to the heater/blower 17 does not carry excessive moisture.

It will be particularly understood that the unloader 29 of the present invention is a metering unloader. That is, upon each revolution of unloader body 37, a given amount of dried grain is picked up by the grain inlet 51 on each revolution of the unloader body in turn from each of the outlets 27 of the grain channels 25. In this manner, it is insured that grain from each of the grain channels 25 will be uniformly unloaded. This overcomes a problem with prior art grain dryers utilizing gravity discharge outlets where grain would be unevenly unloaded from certain of the discharge chutes but would not be as readily unloaded from adjacent chutes. This non-uniform unloading resulted in grain flowing through the drying path 11 at non-uniform rates which resulted in some of the grain possibly becoming overheated and over dried, while other grain that moved through the drying path at a faster rate was under dried.

As noted, motor 41 is a variable speed motor preferably under microprocessor control of control panel 21. By varying the speed at which motor 41 is operated, the rotational speed of unloader body 31 may also be varied thus increasing or decreasing the rate at which grain is unloaded. Of course, as grain is unloaded more quickly, the grain flowing downwardly through the grain drying path 11 will move faster thus increasing the through put and drying capacity of tower dryer T. Those skilled in the art will recognize that by controlling the rate at which unloader body 37 is rotated controls the rate at which grain may be continuously dried by tower T.

By way of example, drive motor 41 may be operated between a very slow speed mode of operation and its normal maximum operating speed such that the motor driving unloader 29 through speed reducer 43 will rotate from a speed slightly more that 0 rpms (revolutions per minute) up to about 30 rpms. However, it has been found that under most operating conditions, the unloader will be rotated between about 10 and 15 rpms. It will be appreciated that with unloader 29 operating between about 10 and 15 rpm, the grain inlet opening 51 in the unloader will move past each of the grain outlets 27 once every 4–6 seconds and remove grain from grain channel 31 thus allowing more grain to flow down each of the grain channels 25 to replace the grain scooped up by the unloader and conveyed from the tower dryer via grain unloading channel 55 in the unloader. This in turn allows the grain in grain drying path 15 to move downwardly at a substantially uniform rate around all regions of the drying path. This insure uniform drying of the grain. Further, by speeding or slowing the rate at which the unloader is rotated, the rate at which the grain moves downwardly (and thus the length of time that the grain in the drying path is exposed to drying air) may be regulated and controlled.

It can be seen that the detailed description of the preferred forms and embodiments of the invention fulfill the objects and advantages set forth above. Inasmuch as numerous modifications may be made to the preferred embodiments without departing from the spirit and scope of the invention, the scope of the invention is to be determined by the scope of the following claims.

What is claimed is:

1. A tower grain dryer including a metering unloader, said tower grain dryer comprising a vertical tower having a plenum therein, said plenum having a plenum wall, said tower having an outer wall surrounding said plenum:wall and being spaced outwardly therefrom for forming a cylindric grain drying path between said tower outer wall and said plenum wall, said grain to be dried being conveyed through said cylindric grain drying path generally from top to bottom of said dryer, said outer wall of said tower and said plenum wall being porous to permit air to flow therethrough, said tower dryer having means for moving air into said plenum, through said plenum wall, through said grain in said grain drying flow path thereby to dry said grain, and through said tower wall to exhaust said air to the atmosphere on the exterior of said outer tower wall, said cylindric grain drying path having a converging hopper section at the bottom of said tower dryer with said grain drying path within said hopper section being divided into a plurality of channels with each of said channels having a grain outlet at the lower end thereof, a floor below said grain outlets, said floor having a grain discharge outlet in a center thereof spaced radially inwardly of said grain outlets, said metering unloader having a generally cylindric unloader body including a cylindric unloader wall, said unloader body being rotatably mounted within a lower portion of said tower above said discharge outlet for rotation about a vertical axis, means for supporting said unloader body and for rotatably driving said unloader body about said vertical axis, said unloader wall extending up from said floor and being spaced relative to said grain outlets of said grain drying path for blocking the gravity flow of grain from said grain outlets toward said discharge opening, said unloader wall having a grain inlet opening therein and a grain unloading path within said unloader body leading from said grain inlet opening in said unloader wall to said grain discharge outlet in said floor, said grain inlet opening receiving grain from each of said grain outlets as said unloader body is rotated about said vertical axis thereby to substantially uniformly remove grain from all of said grain outlets upon each revolution of said metering unloader.

2. A tower grain dryer as set forth in claim 1 wherein said unloading grain path in said metering unloader is of general spiral shape as it extends between said grain inlet and said at least one discharge outlet.

3. A tower grain dryer as set forth in claim 1 wherein said means for supporting said unloader body is mounted within said plenum, said supporting means comprising a vertical shaft, said unloader body carried by said vertical shaft, and a motor for rotating said vertical shaft and said unloader body.

4. A tower grain dryer as set forth in claim 3 wherein said motor is a variable speed motor.

5. A tower grain dryer as set forth in claim 3 further comprising a frame within said plenum for carrying said motor and said unloader body.

6. A lower grain dryer including a metering unloader, said tower dryer comprising a vertical cylindrical tower having a plenum therein, said tower having an outer wall and a bottom wall, said tower having a discharge outlet in said bottom wall, said plenum having an outer wall spaced inwardly of said tower outer wall for forming a cylindric, annular grain drying path therebetween, said tower having a conical shaped hopper at a lower end of said tower with said hopper having a grain generally conical-shaped grain path therein for receiving grain from said cylindric, annular grain drying path in said tower and for gravity conveying said grain from said cylindrical, annular grain dring path to said bottom wall such that grain to be dried is conveyed along said cylindric, annular grain drying path generally from the top of said tower to the bottom of said tower and through said conical-shaped grain path from the top to the bottom of said hopper for the discharge of the dried grain onto said bottom wall, said metering unloader being mounted proximate said tower bottom wall for rotation about a vertical axis, said metering unloader having a generally vertical outer wall spaced radially inwardly of said conical shaped hopper thus defining an annular chamber between the outlets from said conical grain path and said vertical wall with the latter blocking the flow of grain toward said grain discharge outlet in said bottom walk said metering unloader vertical wall having a grain inlet therein for gathering the dried grain from said annular chamber and a grain discharge path extending between said grain inlet and said grain discharge outlet in said bottom wall so that upon rotation of said metering unloader about said vertical axis, dried grain discharged from said conical-shaped grain path continuously enters said grain inlet opening in said unloader wall and is conveyed through said grain discharge path for delivery to said grain discharge outlet in said bottom wall thereby to substantially uniformly remove dried grain from all portions of said grain flow path upon each revolution of said metering unloader.

7. In a tower grain dryer, the later comprising an outer wall, a plenum wall defining a plenum located within said tower grain dryer and being spaced inwardly from said outer wall thereby to form a flow path for the grain to be dried between the outer wall and said plenum wall, means for conveying grain to an upper portion of said tower and for filling said flow path with grain to be dried, means for forcing air into said plenum such that said air may be forced from said plenum into said grain to be dried in said flow path and to be exhausted from said tower outer wall, said tower having a bottom wall with a grain discharge outlet therein, a converging hopper section including a portion of said grain path such that grain is directed toward said grain discharge outlet, wherein the improvement comprises: a metering unloader mounted within said tower proximate said bottom wall for rotation about a vertical axis, means for rotating said unloader about said vertical axis, said unloader having a wall spaced inwardly of a lower portion of said hopper and defining a space therebetween into which space dried grain from said grain path is discharged, said unloader wall having a grain inlet therein, an unloading path within said unloader extending between said grain inlet and said at least one grain discharge outlet in said tower bottom wall such that upon each rotation of said unloader said grain inlet uniformly gathers grain from said hopper and conveys such dried grain radially inwardly toward said discharge outlet.

8. A method of substantially uniformly unloading dried grain from a tower dryer, the later having a plenum therewithin with the walls of said plenum being porous, an outer tower wall surrounding said plenum and defining a grain drying path therebetween, said outer tower wall being porous, means for forcing air into said plenum, through said plenum walls, through said grain in said drying path, and through said outer tower wall for drying said grain in said drying path, said drying path having a converging conical bottom portion with a lowermost end of said conical portion having a plurality of grain outlets for discharge of the dried grain from said outlets onto a bottom floor at the lower portion of said tower, said floor having a discharge outlet through which said dried grain may be unloaded from said tower dryer, said method comprising the steps of:

providing a metering unloader in the lower portion of said tower, said unloader having a cylindric wall with a grain inlet in said cylindric wall in communication with said dried grain discharged from the outlet end of said drying path, a discharge end in register with said discharge opening, and a grain path between said grain inlet and said discharge end;

discharging dried grain from each of said grain outlets into an annular space between said grain outlets and said cylindric wall of said unloader with said vertical wall blocking gravity flow of such grain in said annular space toward said discharge outlet in said bottom floor;

rotating said metering unloader about a vertical axis;

as said grain inlet in said metering unloader rotates past each of said grain outlets, permitting dried grain from each of said grain outlets to enter said grain path within said unloader and to convey said dried grain through said path within said unloader to said discharge outlets and said cylindric wall of said metering unloader preventing the flow of grain out of said grain outlets and out of said annular space when said grain inlet is out of register with such grain outlets; and discharging said dried grain from said tower dryer via said discharge outlet.

9. The method of claim 8 further comprising the step of varying the speed at which said metering unloader is rotated about said vertical axis so as to vary the rate at which grain is discharged from said dryer.

10. The method of claim 8 further comprising the step of varying the speed at which said metering unloader is rotated about said vertical axis so as to vary the rate at which grain is dried in said dryer.

* * * * *